US008069628B2

(12) United States Patent
Jonville et al.

(10) Patent No.: US 8,069,628 B2
(45) **Date of Patent: *Dec. 6, 2011**

(54) RING FURNACES WITH IMPROVED EXPANSION JOINTS AND BRICKS DESIGNED TO BUILD IT

(75) Inventors: Christian Jonville, Corenc (FR); Jean Bigot, Coublevie (FR)

(73) Assignee: Aluminum Pechiney, Voreppe (FR)

( * ) Notice: Subject to any disclaimer, the term of this patent is extended or adjusted under 35 U.S.C. 154(b) by 969 days.

This patent is subject to a terminal disclaimer.

(21) Appl. No.: 11/995,486

(22) PCT Filed: Jul. 10, 2006

(86) PCT No.: PCT/FR2006/001675

§ 371 (c)(1),
(2), (4) Date: Jan. 11, 2008

(87) PCT Pub. No.: WO2007/006962

PCT Pub. Date: Jan. 18, 2007

(65) Prior Publication Data

US 2009/0126306 A1 May 21, 2009

(30) Foreign Application Priority Data

Jul. 12, 2005 (FR) ..... 05 07455

(51) Int. Cl.
*E04B 2/00* (2006.01)

(52) U.S. Cl. ..... 52/506.02; 52/573.1

(58) Field of Classification Search ..... 52/506.02, 52/573.1, 603, 245; 432/249, 251
See application file for complete search history.

(56) References Cited

U.S. PATENT DOCUMENTS 5,277,580 A 1/1994 Miskolczi, Jr. et al.

FOREIGN PATENT DOCUMENTS

| | | |
|---|---|---|
| EP | 0727620 A | 8/1996 |
| FR | 2724714 A | 3/1996 |
| GB | 671391 A | 5/1952 |

*Primary Examiner* — Basil Katcheves
(74) *Attorney, Agent, or Firm* — Banner & Witcoff, Ltd.

(57) ABSTRACT

The invention relates to ring furnaces of which at least one of the inner partitions is formed by a plurality of bricks made of refractory material including at least a first brick and a second brick placed above or below a third brick and separated from one another by a space of width J, in which the first brick has at least one recess on its assembly face opposite the third brick, the third brick has at least one projection on its assembly face facing the first brick, wherein the projection is inserted into the recess, the dimension E of said recess in the longitudinal direction of the partition is greater than the dimension B of said first projection in the same direction, and said recess is positioned at a determined distance Se from the end face adjacent to said space.

19 Claims, 7 Drawing Sheets

RING FURNACES WITH IMPROVED EXPANSION JOINTS AND BRICKS DESIGNED TO BUILD IT

FIELD OF THE INVENTION

The invention relates to the field of sectional furnaces or "ring furnaces" for the firing of carbonaceous blocks, and especially open type ring furnaces. The invention relates more specifically to the partitions of these furnaces (especially the hollow partitions and the transversal walls) and the bricks used in these partitions.

STATE OF THE ART

Open type ring furnaces are well known and described, especially in the French patent applications FR 2 600 152 (corresponding to the U.S. Pat. No. 4,859,175) and FR 2 535 834 (corresponding to the British application GB 2 129 918).

A ring furnace comprises a succession of aligned sections, wherein each section is defined by transversal walls and comprises a plurality of elongated shaped pits separated by hollow heated partitions. The section partitions are formed by refractory bricks, such as those described in the international applications WO 95/22666 and WO 97/35150.

The increase in temperature of the sections during the firing cycles of the carbonaceous blocks causes the partitions to expand, which can damage them or deform them or even deform the casing of the furnace. In order to avoid these difficulties, it is known to leave certain bricks free to slide over one another and to create a small space, called an "expansion joint", between certain bricks. These joints absorb the expansions of the partitions. Certain joints are moreover filled with a compressible refractory material in order to make them impervious and prevent the packing material contained in the pits to pass through them during the firing of the carbonaceous blocks. This type of impervious joint is especially used at the junction between the hollow partitions and the transversal walls.

However, the expansion joints do not operate satisfactorily once the furnaces are very large in size, as the relative movements between certain bricks become sufficiently large that they affect the cohesion of the partition and deteriorate the imperviousness of the impervious expansion joints. In this case, packing material may enter into the partitions via the expansion joints, which can lead to blocking of the passage of the smoke, and between the hollow partitions and the transversal walls, which further limits the expansion movement of these partitions.

These difficulties limit the increase in the capacity of the ring furnaces, the improvement of their energy performance and the reduction in the investment costs.

The applicant has sought means to overcome these disadvantages of the prior art.

DESCRIPTION OF THE INVENTION

An object of the invention is a ring furnace comprising a plurality of inner partitions forming a series of distinct firing sections and pits inside these sections, said partitions comprising transversal walls to separate said sections and hollow partitions to separate the pits, at least one of said inner partitions being formed by a plurality of bricks made of a refractory material including at least a first, a second and a third brick, each comprising at least two opposite lateral faces, positioned parallel to the longitudinal direction L of the partition, two opposite end faces and two opposite assembly faces and each comprising at least one flat surface, said first and said second bricks being located above or below said third brick and positioned so that their end faces facing one another are separated by a space of width J, characterised in that said first brick includes at least a first recess on its assembly face facing said third brick, said recess having a dimension E in said longitudinal direction L of said partition, in that said third brick includes at least a first projection on its assembly face facing said first brick, said first projection having a dimension B in said longitudinal direction L of said partition and entering into said recess, in that, so as to allow relative movements between said first and said third brick in said longitudinal direction of said partition when said furnace is being used, said dimension E of said recess is greater than said dimension B of said first projection, and in that, so as to form a stop for said projection on the side of said space, said recess is positioned at a determined distance Se from the end face adjacent to said space.

Said space of width J forms an expansion joint, which absorbs the relative movements between said first brick and said third brick in the longitudinal direction of the partition, which occurs when the bricks expand or contract under the effect of the variations of temperature of the furnace during its operation, and thus avoids stressing the partition. As the relative movements are limited by the stop on the side of the joint, the cohesion and the solidity of the partition are maintained during the movements caused by the expansion and the contraction of the bricks. The projection and the recess according to the invention act as flexible locking members of the bricks.

Another object of the invention is a brick made of refractory material, designed to be used in the inner partitions of a ring furnace, comprising at least two opposite lateral faces, a first end face, a second end face opposite said first end face, a first assembly face comprising at least one flat surface and at least a first projection and a second assembly face opposite said first assembly face and comprising at least one flat surface and at least a first recess, said projection having a dimension B in a direction parallel to said lateral faces, said recess having a dimension E in a direction parallel to said lateral faces, characterised in that said dimension E is greater than said dimension B, and in that said recess is positioned at a determined distance Se from said first end face. Said first recess is typically substantially opposite said first projection. Said first projection is typically positioned at a determined distance Sb from said first end face. Preferably, the centre of said first recess is offset by a distance Cp with respect to the centre of said first projection.

In one advantageous embodiment of the invention, said first projection is a first straight tongue that is positioned perpendicularly to said lateral faces and whose width is equal to said dimension B, and said first recess is a first straight groove, that is disposed perpendicularly to said lateral faces and whose width is equal to said dimension E. According to one variant of this embodiment, the brick further includes a second straight groove, positioned perpendicularly to said lateral faces, and the width E' of this second groove is smaller than said dimension E. This variant makes it possible for a brick according to the invention to be associated to one or more standard bricks in a partition. According to an alternative variant of the invention, the brick further includes a second straight groove, positioned perpendicularly to said lateral faces, and the width E' of this second groove is substantially equal to said dimension E. This variant makes it possible to obtain flexible locking according to the invention at both ends of the brick. In these variants, said second groove is typically on the same assembly face as said first straight groove, but may possibly be situated on the opposite assembly face. Said second straight groove is typically positioned at a determined distance Se' from said second end face. A brick according to these variants typically further includes a second tongue, positioned perpendicularly to said lateral faces and situated on the same assembly face as said first tongue. The width B' of this second tongue is typically substantially equal to said dimension B. Said second straight tongue is positioned at a determined distance Sb' from said second end face.

Yet another object of the invention is the use of a ring furnace according to the invention for the firing of carbonaceous blocks.

Yet another object of the invention is a manufacturing process of carbonaceous blocks in which:

raw carbonaceous blocks are introduced into a furnace according to the invention;

a determined firing cycle is carried out;

the fired carbonaceous blocks are removed from the furnace.

The invention is described in detail below with the aid of the appended figures relating to the preferred embodiments of the invention.

Figure 1:
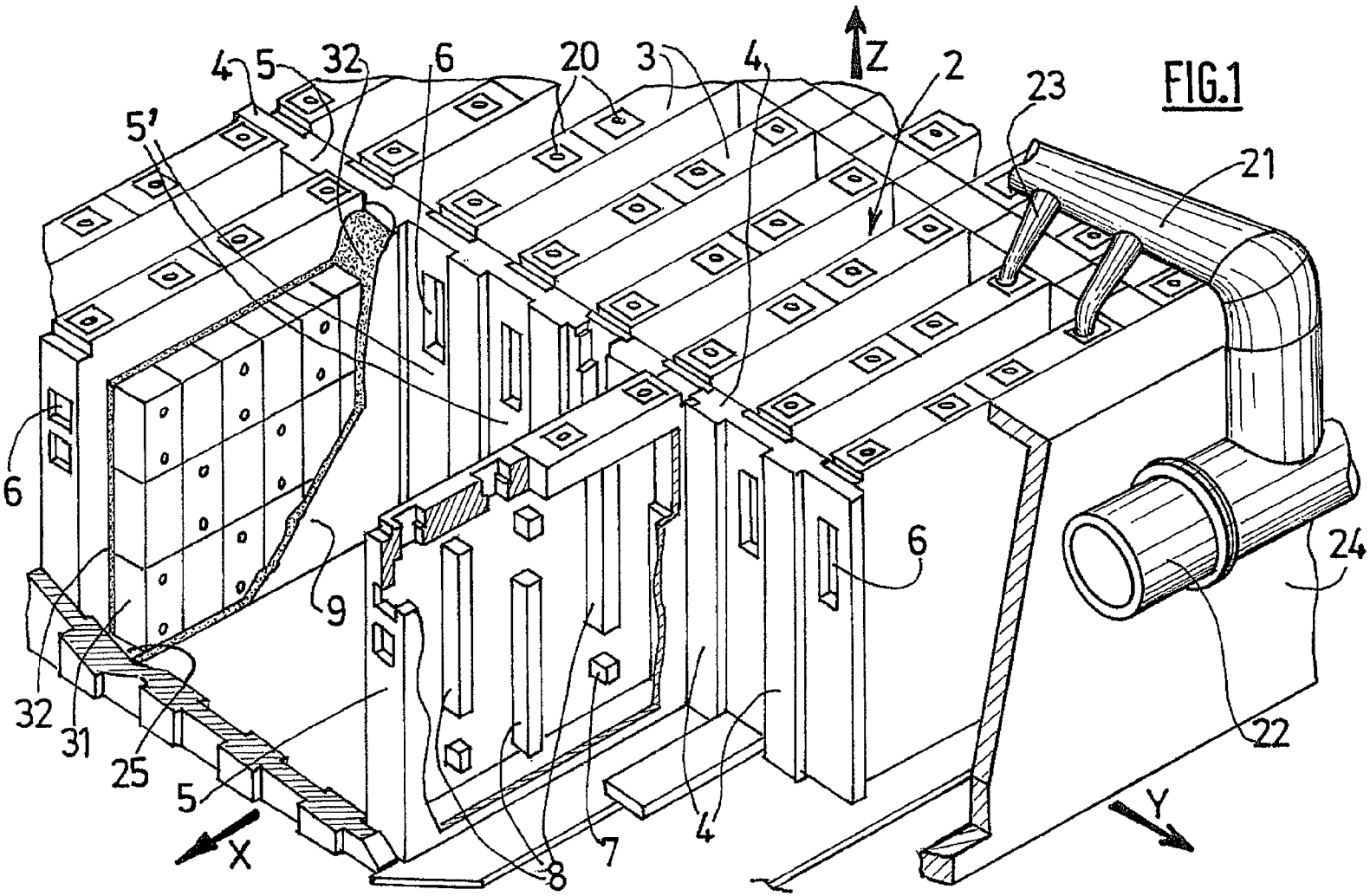
FIG. 1 illustrates a perspective view, partially exploded, of an open ring furnace.
Figure 2:
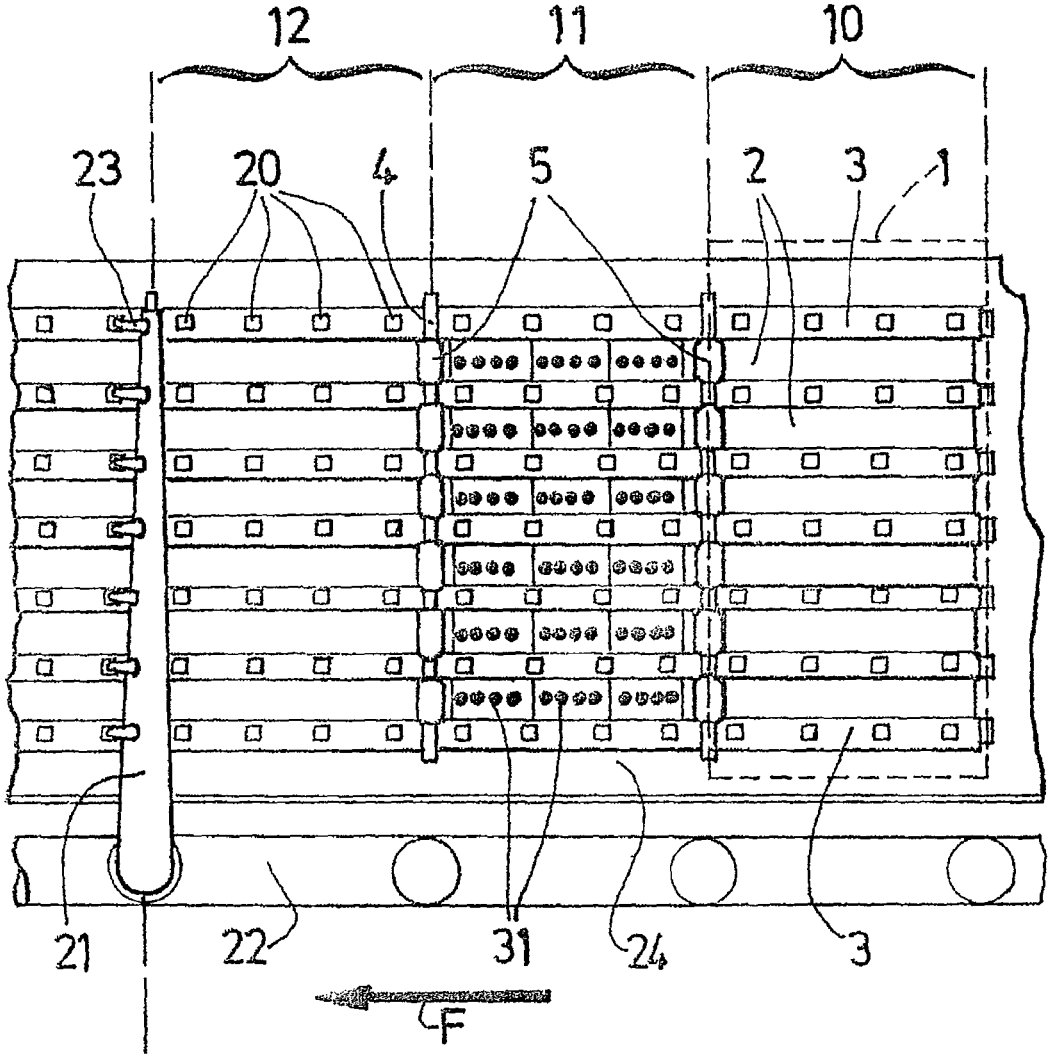
FIG. 2 illustrates, viewed from above, a ring furnace bay.

As illustrated in FIGS. 1 and 2, a ring furnace comprises a succession of sections (10, 11, 12, . . . ) positioned in series. Each section comprises alternately, in the transversal direction (Y axis), pits (2) of an elongated shape and hollow partitions (3) positioned in the longitudinal direction (X axis). By way of illustration, the dotted line (1) of FIG. 2 defines one of the sections and shows that it comprises several pits (2) positioned in parallel and separated by hollow partitions (3). The transversal walls (4) separate the sections from one another.

The pits (2) are defined by hollow partitions (3), pillars (5) of transversal walls (4) and a floor (25). The hollow partitions (3) and the pillars (5) of transversal walls (4) form walls that are substantially vertical; the floor (25) forms a bottom that is substantially horizontal. The hollow partitions (3) include thin lateral walls (9) generally separated by tie bricks (7) and baffles (8). The ends of the hollow partitions (3) are embedded in the indentations (5') of the transversal walls (4). The indentations (5') are fitted with apertures (6) in order to allow the gases circulating in the hollow partitions (3) to pass from one section to the next. The hollow partitions (3) are fitted with means of access (20) called "peepholes" which especially are used to introduce heating means (such as burner injectors) (not illustrated) or suctions pipes (23) connected to a ramp (21) and connected to a main conduit (22) running alongside the furnace.

The ring furnaces thus include a plurality of inner partitions (3, 4) which form a series of distinct firing sections and pits inside these sections. These inner partitions (3, 4) are generally essentially made of refractory bricks (15, 16, 17). The bricks are typically alumina and silica based. The bricks may be directly in contact ("dry" assembly) or an embedding material may be placed between the bricks. Several of these bricks have projections and recesses of substantially complementary shapes which fit into one another, thus ensuring the blockage of the bricks and stabilisation of the partition.

The sections form a long bay in the direction F of the fire. A ring furnace typically comprises two parallel bays, each having a length of around one hundred meters. The bays are generally defined by lateral walls (24).

During firing operations, a gaseous flow composed of air, heating gas, the vapours given off by the carbonaceous blocks or combustion gases (or, most often, a mixture of them) circulates, in the longitudinal direction of the furnace (X axis), in a succession of hollow heated partitions (3) that communicate with one another. This gaseous flow is blown upstream of the active sections and is sucked downstream of them. The heat produced by the combustion of the gases is transmitted to the carbonaceous blocks (31) contained in the pits (2), which leads to their firing.

A firing cycle of carbonaceous blocks, for a given section, typically includes the loading of the pits of this section in raw carbonaceous blocks, the heating of this section up to the firing temperature of the carbonaceous blocks (typically from 1100 to 1200° C.), the cooling down of the section to a temperature that makes it possible to remove the fired carbonaceous blocks and the cooling down of the section to ambient temperature. The principle of the ring furnace process consists of successively carrying out the heating cycle on the sections of the furnace by moving the heating means (such as burner ramps) and suction means. In this way, a given section successively passes through periods of preheating, firing and cooling down. FIG. 1 shows a typical stack of carbonaceous blocks (31) in a pit (2), with packing material (32), during their firing operation. The packing material is typically carbonaceous powder or silica based.

The increase in temperature of the furnace during a firing cycle causes the expansion of the inner partitions (3, 4) of the furnace. In order to avoid damaging the furnace during this expansion, the hollow partitions (3) are typically embedded in the indentations (51) of the transversal walls (4) so that they can move without any significant impediment in the indentations during the increases and decreases in temperature of the furnace. For example, a space may be left, called an "expansion joint", between the hollow partitions (3) and the indentation walls (5'). This space generally contains a compressible refractory material, such as a refractory ceramic fibre, in order to make it impervious and to avoid introducing packing material between the hollow partitions (3) and the transversal walls (4). In the same aim, expansion joints (13, 14) can be made in the transversal walls (4) formed by an empty space between certain bricks.

The bricks (15, 15', 15") used to make the expansion joints (13, 14) typically include at least:

two opposite lateral faces (151), typically flat and generally parallel, which are designed to be placed in the longitudinal direction L of a partition;

two opposite end faces (152, 152'), that are typically perpendicular to the lateral faces (151), and are designed to be positioned each facing an end face of adjacent bricks in said partition;

a first assembly face (153) comprising at least one flat surface (154) and at least one projection (155) of a determined shape;

a second assembly face (156), opposite said first assembly face and comprising at least one flat surface (157) and at least one recess (158) of a determined shape.

Said flat surface (154) of said first assembly face (153) is parallel to said flat surface (157) of said second assembly face (156).

These bricks have a length L1 (defined as the distance between the two opposite end faces (152, 152')), a width L2 (defined as the distance between the two opposite lateral faces (151)) and a thickness L3 (defined as the distance between the flat surfaces (154, 157) of the two opposite assembly faces (153, 156)). By way of example, typical dimensions of the bricks according to the invention are as follows: L1 from 200 to 400 mm, L2 from 200 to 300 mm and L3 from 80 to 150 mm when the bricks are intended for transversal walls (4); L1 from 200 to 400 mm, L2 from 80 to 150 mm and L3 from 80 to 150 mm when they are intended for hollow partitions (3).

In the partition, the projections (155) of a brick are inserted in the corresponding recesses (158) of another brick, situated above or below in the partition, which makes it possible to consolidate the partition.

Each of the projections (155) has a dimension B in a direction parallel to the lateral faces (151) of the brick. The dimension B may be different for each projection. The dimension B is typically given with respect to the junction line of each projection (155) with the flat surface (154) of the corresponding assembly face (153) or with respect to a line equivalent to the junction line. Similarly, each of the determined recesses (158) has a dimension E in a direction parallel to the lateral faces (151) of the brick. The dimension E may be different for each projection. The dimension E is typically given with respect to the junction line of each recess (158) with the flat surface (157) of the corresponding assembly face (156) or with respect to a line equivalent to the junction line. When the brick is placed in a partition, the dimensions B and E are in its longitudinal direction L.

According to the invention, for certain bricks, as shown especially in FIG. 3, the dimension E or E' of at least one of said recesses (158*d*, 158'*d*) is greater than the corresponding dimension B or B' of the corresponding projection (155*d*, 155'*d*) of an adjacent brick, generally positioned below it, and the edge of the recess or of each recess (158*d*, 158'*d*) is positioned at a determined distance Se or Se' (respectively) of at least one of said end faces (152, 152'), which is to say at least the end face situated on the side of said space (13, 14), so as to form a stop. The determined distances Se and Se' are typically between 10 and 30% the length L1 of the corresponding bricks (15*a*, 15*b*).

The clearance between a recess (158*d*, 158*d*') and the corresponding projection (155*d*, 155'*d*), which is to say the extra dimension of the recess with respect to the projection, allows relative movements of said first brick with respect to said third brick in said longitudinal direction of the partition when the bricks of the partition expand or contract under the effect of the variations in temperature of the furnace during its operation. These movements cause variation in the width of said expansion joint, which thus absorbs the variations of the dimension of the bricks of the partition.

The corresponding or each corresponding projection (155*d*, 155'*d*) may also be positioned at a determined distance Sb or Sb' (respectively) from the corresponding end face (152, 152'), which is designed to be adjacent to said space (13, 14). The determined distances Sb and Sb' are typically between 10 and 30% of the length L1 of said bricks (15*a*, 15*b*).

Figure 3:
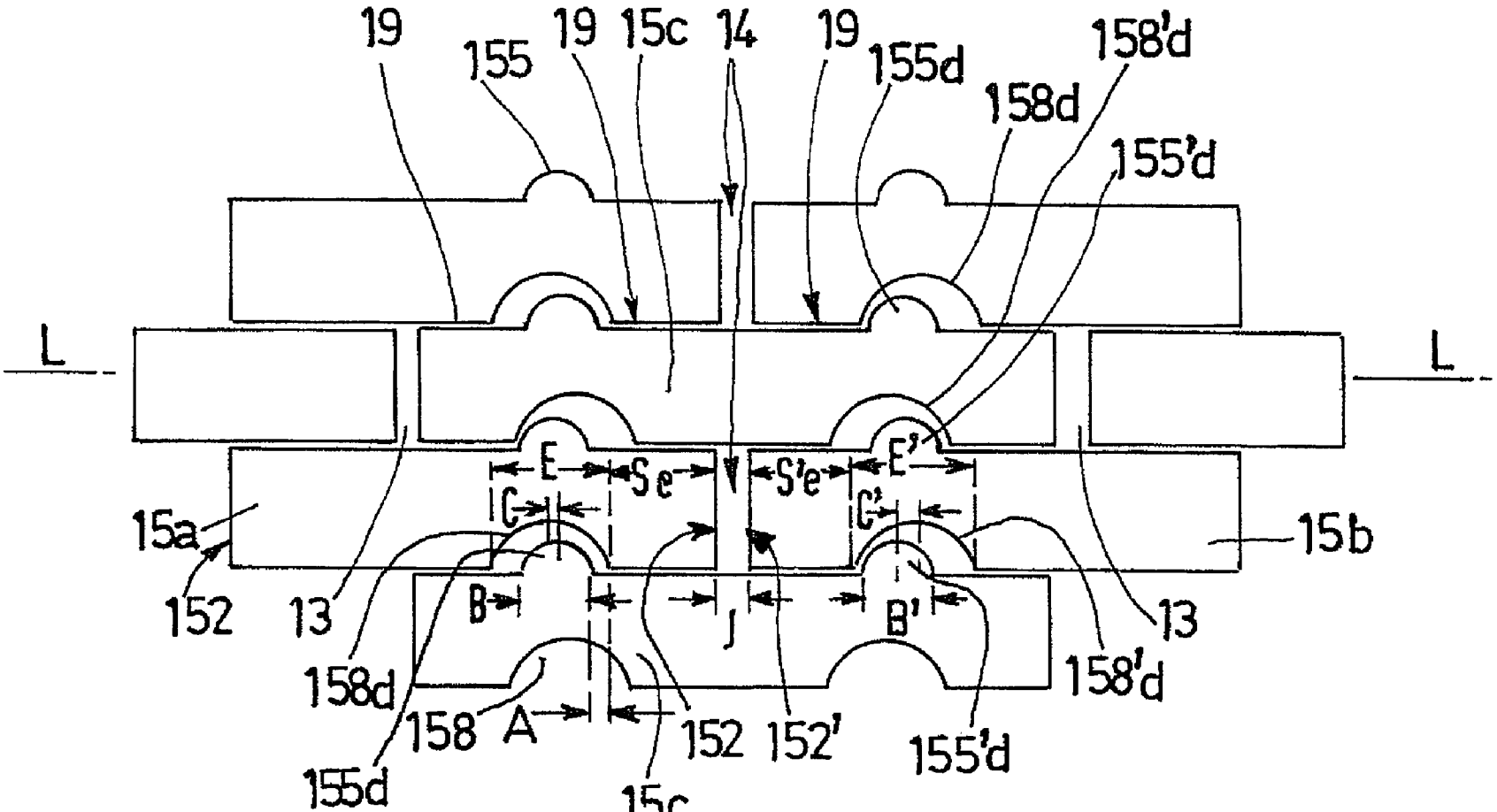
FIG. 3 illustrates an assembly of bricks according to one embodiment of the invention.

In the embodiment of the invention illustrated in FIG. 3, said recess (158*d*, 158'*d*) does not extend up to the end face opposite the joint, which is to say that it does not open out onto this end face.

Said dimensions E and E' are preferably less than approximately 20% of the length L1 of the bricks, and typically less than about 15% of L1, in order to avoid weakening it.

Figure 5:
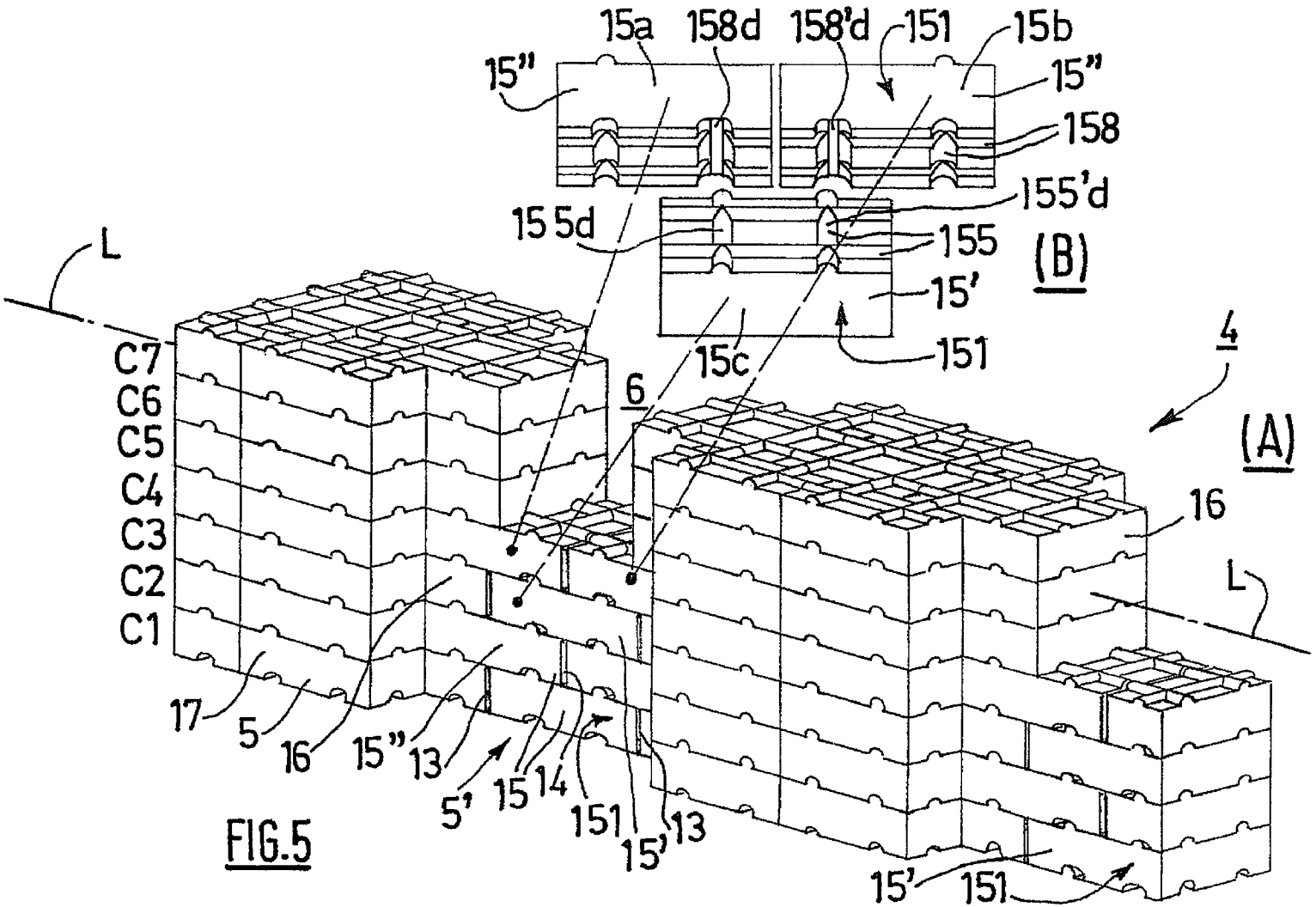
FIG. 5 illustrates the structure of a transversal wall of a furnace according to the invention in a perspective view.

In FIGS. 3 and 5, the bricks 15*a*, 15*b* and 15*c* respectively correspond to said first, second and third bricks.

Said expansion joint (13, 14) corresponds to the space, of width J, between the end face of said first brick (15*a*) and the end face of said second brick (15*b*) facing it. Said expansion joint (13, 14) is preferably situated substantially in the centre of said third brick (15*c*) in order to simplify the making of the assembly.

A partition typically includes a plurality of expansion joints (13, 14), preferably at least one expansion joint per continuous row of bricks. The use of several expansion joints for a same row of bricks allows the compensation of the expansions to be spread out and thus avoid a large aperture between the two bricks defining the joint, which could weaken the partition. In practice, as shown in FIG. 5, it is sufficient to provide expansion joints simply in the rows of bricks that are not interrupted by an aperture (6) (rows C1 to C4 in FIG. 5).

The expansion joints of a partition may be of different widths J. For example, the partition illustrated in FIG. 5 comprises expansion joints of two different widths, which is to say the joints 13 have a first width J1 and the joints 14 have a second width J2. In order to obtain the same degree of freedom to absorb the expansion of the bricks in this particular case, said first width J1 of the joints 13 is equal to about half of said second width J2 of the joints 14 because the rows C1 and C3 include a number of expansion joints (13) equal to twice the number of expansion joints (14) of the intermediate rows C2 and C4.

The width J of the expansion joints is preferably small with respect to the length L1 of the bricks in order to avoid substantially affecting the strength of the partition. The width J is typically 5 mm to 20 mm. In the case illustrated in FIG. 5 where the joints have two different widths, said first width J1 is typically between 10 and 20 mm and said second width J2 is typically between 5 and 10 mm.

According to the invention, said first, second and third bricks are not fastened rigidly to one another in order to allow their relative movement during the operation of the furnace. In particular, it is preferable not to introduce sealing material between these bricks. A non-sealing refractory material may advantageously be placed between these bricks to facilitate their relative movements, to adjust the level and/or improve their imperviousness.

In a preferred embodiment of the invention, said second brick (15*b*) also has at least one recess (158'*d*) on its assembly face facing said third brick (15*c*), said recess (158'*d*) having a dimension E' in the longitudinal direction L of the partition, said third brick (15*c*) has at least a second projection (155'*d*) on its assembly face facing said second brick (15*b*), said second projection (155'*d*) having a dimension B' in the longitudinal direction L of the partition and being inserted in said recess, the dimension E' of said recess (158'*d*) is greater than the dimension B' of said second projection (155'*d*), and said recess (158'*d*) is positioned at a determined distance Se' from the end face (152') adjacent to said space (13, 14). This preferential configuration permits the design and manufacture of the partition to be simplified substantially.

FIG. 3 illustrates an embodiment in which each of the two bricks defining the expansion joint (13, 14), which is to say said first (15*a*) and second (15*b*) bricks, has a locking member according to the invention, which is to say a recess (158*d*, 158'*d*) wider than the corresponding projection (155*d*, 155'*d*) on said third brick (15*c*) and positioned at a determined distance (Se, Se') from the space (13, 14) forming said expansion joint. In this embodiment, the dimensions (E and E', B and B') and the distances (Se and Se', Sb and Sb') are typically substantially equal, respectively.

The difference D or D' between said dimension E or E' and said dimension B or B', respectively, is preferably greater than 10 mm, more preferably greater than 12 mm, and typically between 14 and 20 mm. A difference of less than 10 mm does not permit a sufficient margin of relative movement of said bricks to compensate the expansion of the partition.

In FIGS. 3 and 5, said first brick (15*a*) is situated above said third brick (15*c*), said recess (158*d*) is turned facing downwards and is positioned on said first brick (15*a*) and said corresponding first projection (155*d*) is turned facing upwards and is positioned on said third brick (15*c*). The configuration is preferably the same in the variant of the invention in which said second brick (15*b*) has a recess (158'*d*) and said third brick (15*c*) has a second projection (155'*d*).

Advantageously, the bricks may be superposed so that, when cold (when the partition is assembled), the centre of said first and/or second projection (155*d*, 155'*d*) is offset by a determined distance C or C', respectively, with respect to the centre of the corresponding recess (158*d*, 158'*d*). For example, as illustrated in FIGS. 3 and 5, the centre of the recess (158*d*, 158'*d*) is further from the expansion joint (13, 14) than the centre of the projection (155*d*, 155'*d*); the space A between the surface of the projection (155*d*, 155'*d*) and the surface of the corresponding recess (158*d*, 158'*d*) is then smaller on the expansion joint side (and thus of said space (13, 14)) than on the opposite side. This disposition allows the aperture of the expansion joint to be effectively restricted when the furnace is in operation.

In order to limit the gaseous exchanges through the partition, said projections (155*d*, 155'*d*) and said first and second recesses (158*d*, 158'*d*) may not extend up to at least one of said lateral faces (151), which is to say that they may not open out onto at least one of the lateral faces (151).

The projections (155) and the recesses (158) may have different shapes. As illustrated in FIGS. 3 to 7, the projections (155) typically have the shape of tongues and the recesses (158) have the shape of grooves. In one advantageous embodiment of the invention, said first projection (155*d*) is a first straight tongue, positioned perpendicularly to the lateral faces of the brick (and thus perpendicularly to the longitudinal direction L of the partition), and said first recess (158*d*) is a first straight groove, positioned perpendicularly to the lateral faces of the brick (and thus perpendicularly to the longitudinal direction L of the partition). The width of said first straight tongue corresponds to said dimension B and the width of said first straight groove corresponds to said dimension E. Similarly, if applicable, said second projection (155'*d*) is advantageously a second straight tongue, positioned perpendicularly to the lateral faces of the brick (and thus perpendicularly to the longitudinal direction L of the partition), and said corresponding recess (158'*d*) is advantageously a straight groove, positioned perpendicularly to the lateral faces of the brick (and thus perpendicularly to the longitudinal direction L of the partition). The width of said second straight tongue corresponds to said dimension B' and the width of the corresponding straight groove corresponds to said dimension E'.

Advantageously, said first (15*a*) and second (15*b*) bricks have in addition at least one straight groove (158*a*, 158*b*) positioned in parallel to the lateral faces (151) (and thus in parallel to the longitudinal direction of the partition) and said third brick (15*c*) has at least one straight tongue (155*a*, 155*b*) also positioned in parallel to the lateral faces (151) (and thus in parallel to the longitudinal direction of the partition) and corresponding to said straight tongue. These tongues and these grooves may thus guide the movement of the bricks with respect to one another during the thermal expansions and maintain the cohesion of the partition. In order to simplify their fabrication and use, the bricks according to this variant of the invention advantageously have at least one straight tongue (155*a*, 155*b*) positioned in parallel to said lateral faces (151) on an assembly face (typically on said first assembly face (153)) and at least one straight groove (158*a*, 158*b*), corresponding to said straight tongue (and facing it), also positioned in parallel to the lateral faces (151) on the opposite assembly face (typically on said second assembly face (156)).

In order to obtain simply the extra dimension according to the invention, the straight groove or each straight groove (158*d*, 158'*d*) may have a bottom that is substantially flat and has a determined width P or P', this width being typically greater than or equal to said difference D or D', respectively. This variant of the invention has the advantage of allowing a reduction in the thickness of the brick at the groove(s) (158*d*, 158'*d*) to be avoided. In the embodiment illustrated in FIG. 4, the centre of the recess designed to be situated on the side of said space (13, 14) is then at a distance Sc (typically equal to d2+P/2) from the corresponding end face (152). The distance Sc is typically between 15 and 30% of the length L1 of the brick.

Figure 4:
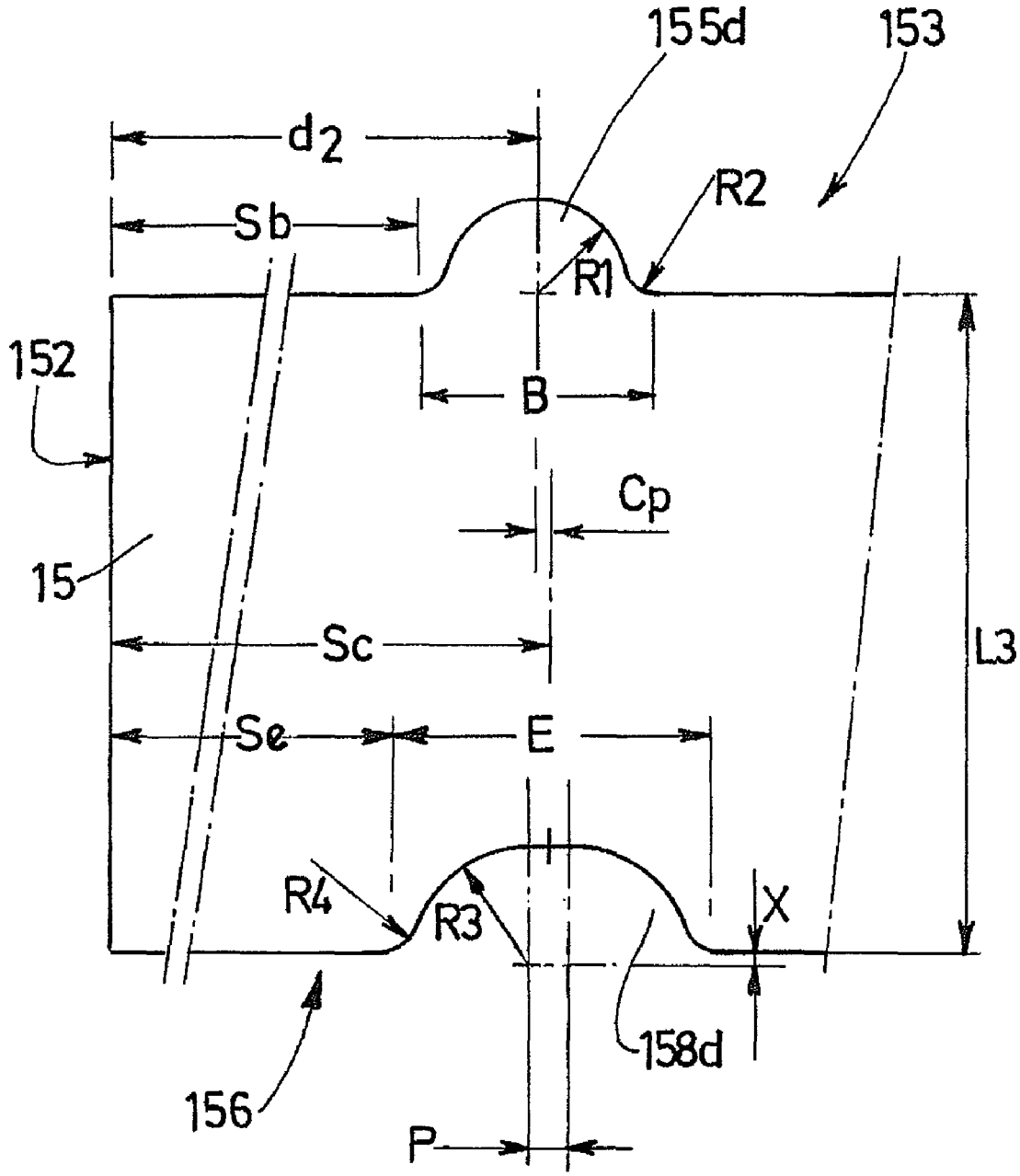
FIG. 4 illustrates an advantageous embodiment of projections and recesses of refractory bricks according to the invention.

As illustrated in the example in FIG. 4, the centre of said projection (155*d*) may be offset by a determined distance Cp with respect to the centre of the corresponding recess (158*d*). The offset distance Cp is small with respect to the length L1 of the brick; it is typically between 5 and 12 mm. In this example, the offset Cp is substantially equal to half the width P of the flat bottom of the corresponding grooves and typically corresponds to half said difference D.

Figure 6:
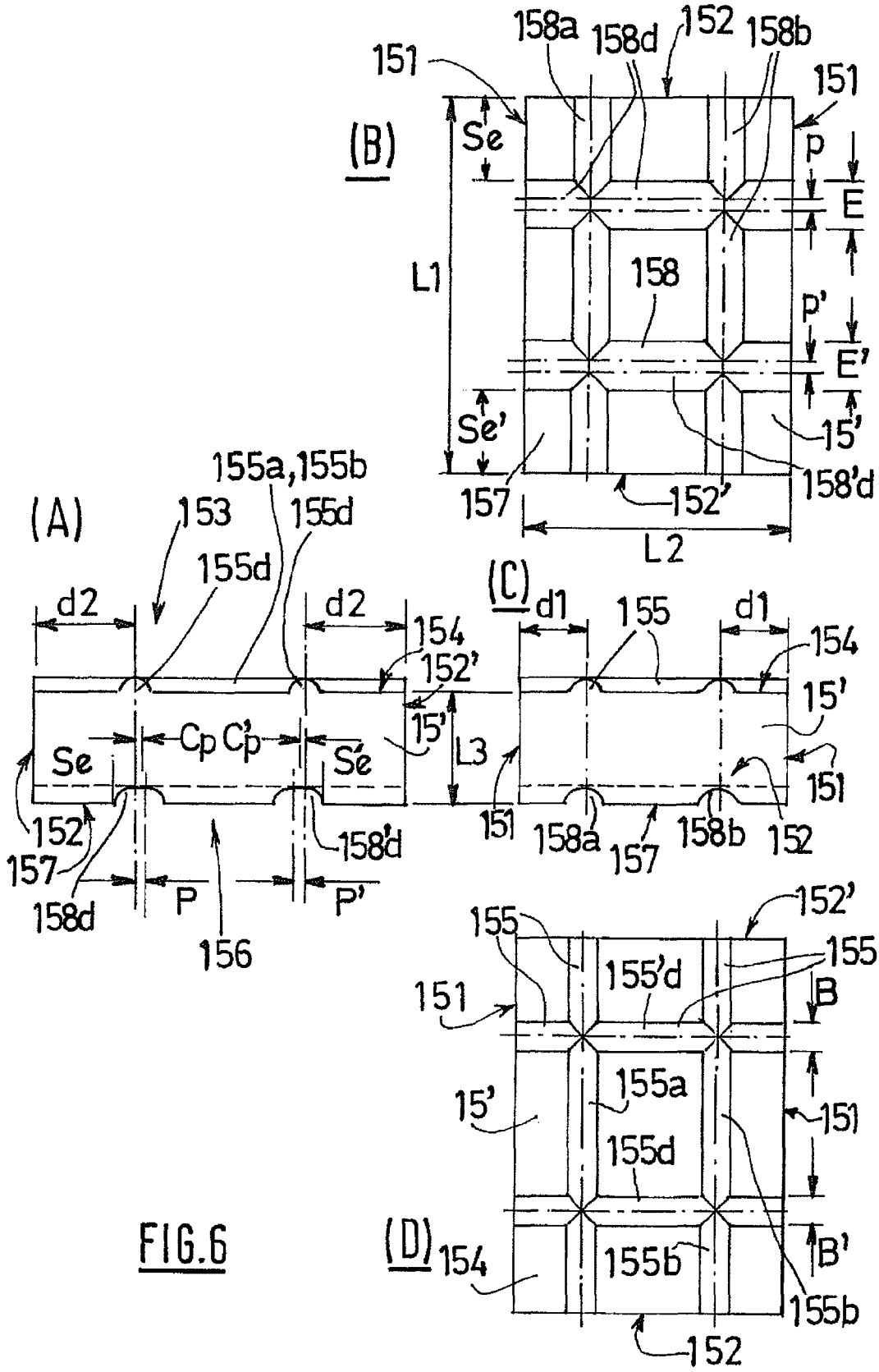
FIGS. 6 and 7 illustrate refractory bricks according to one embodiment of the invention, viewed from different directions.
Figure 7:
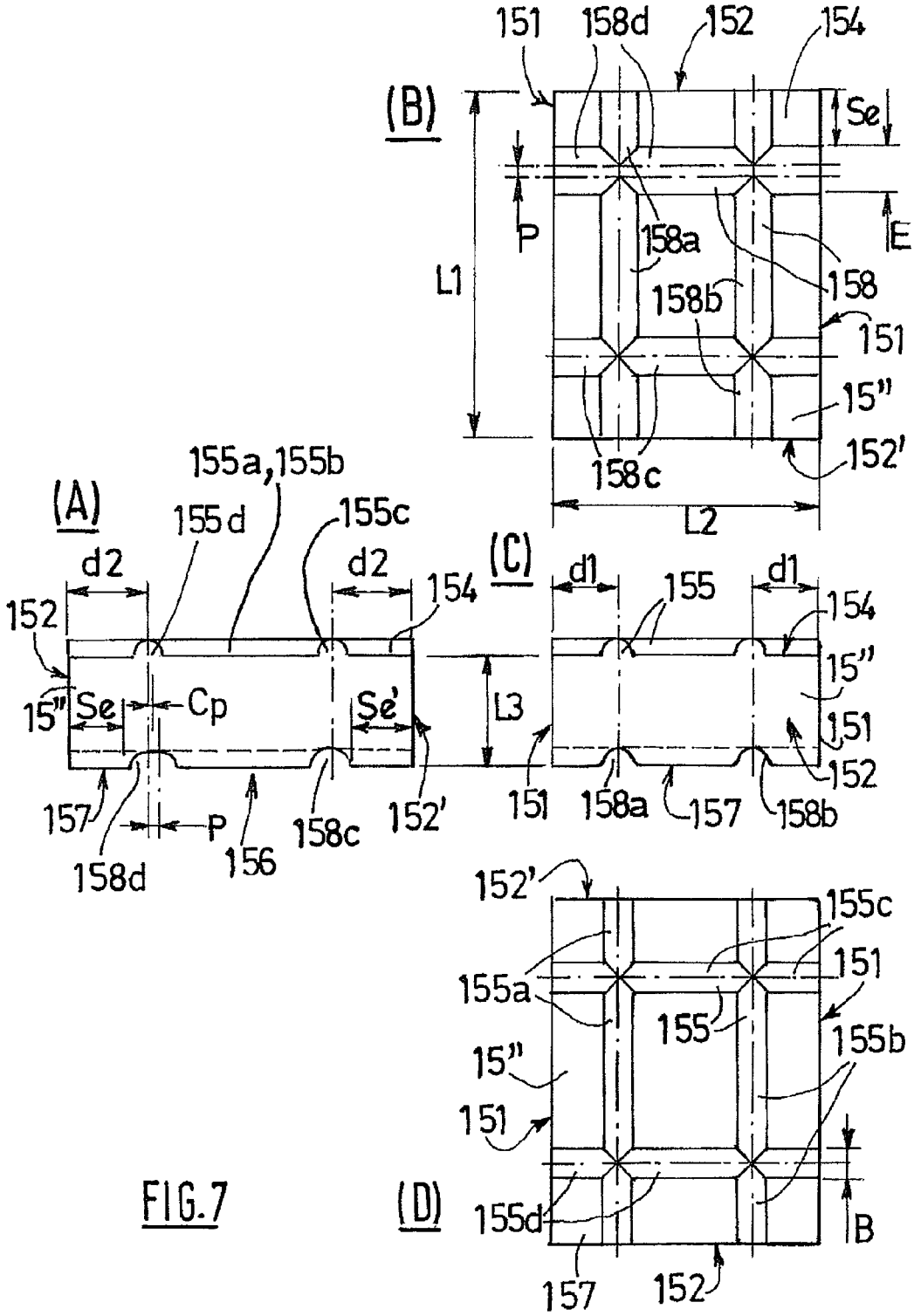

The invention advantageously applies to the case where said partition is one of the transversal walls (4) of said furnace, as these walls are generally very long. The invention is particularly advantageous in the case where said walls (4) have indentations (5') in which hollow partitions (3) are embedded, as the restriction of the relative movements of the bricks makes it possible to limit the variations in width of the indentation (5') and to preserve the imperviousness of the impervious expansion joints between the hollow partitions (3) and the edge of the indentations (5'). In this application, the wall typically has bricks according to the invention (15', 15") and known bricks (16, 17). The bricks (15', 15") according to the invention, and more precisely said first (15*a*), second (15*b*) and third (15*c*) bricks, are positioned completely or partially in the indentations (5'). FIGS. 5 to 7 relate more specifically to this advantageous application of the invention.

FIG. 5(A) shows a layout of the bricks of a transversal wall (4) according to the invention, shown in a partial perspective view. FIG. 5(B) illustrates the interlocking of said first (15*a*), second (15*b*) and third (15*c*) bricks. In this example, the brick 15*c* is a "double joint" brick (15'), as illustrated in FIG. 6, and the bricks 15*a* and 15*b* are "mixed" or "single joint" bricks (15"), as illustrated in FIG. 7.

In FIGS. 6 and 7, figure (A) corresponds to a side face (151) of the brick, figure (B) corresponds to an assembly face (153 or 156), figure (C) corresponds to an end face (152) and figure (D) corresponds to the assembly face opposite that of figure (B).

The bricks (15') situated in the centre of the indentations (5'), and shown in FIG. 6, have, on one assembly face (153), two straight tongues (155*a*, 155*b*) parallel to the lateral faces (151) and positioned at the same distance d1 from the lateral faces (151), and, on the opposite assembly face (156), two straight grooves (158*a*, 158*b*), parallel to the lateral faces (151), substantially opposite corresponding tongues (155*a*, 155*b*) and substantially complementary to them. These bricks (15') also have, on one assembly face (153), two straight tongues (155*d*, 155'*d*) perpendicular to the lateral faces (151) and positioned at a same distance d2 from the end faces (152, 152'), and, on the opposite assembly face (156), two straight grooves (158*d*, 158'*d*), perpendicular to the lateral faces (151), substantially opposite corresponding tongues (155*c*, 155*d*) and substantially complementary to them. The width E and E' of these two latter grooves (158*d*, 158'*d*) has an extra width P and P' with respect to the width B and B' of the two corresponding tongues (155*d*, 155'*d*).

The bricks (15") situated on the side of the indentations (5'), and shown in FIG. 7, have, on one assembly face (153), a first straight tongue (155*d*), perpendicular to the lateral faces (151) and positioned at a distance d2 from a first end face (152), and, on the opposite assembly face (156), a first straight groove (158*d*), perpendicular to the lateral faces (151), substantially opposite to a corresponding tongue (155*d*) and substantially complementary to it. The width E of this first groove (158*d*) is larger by and extra width P with respect to the width B of the corresponding first tongue (155*d*). These bricks (15") also have, on the same assembly face (153) as the first tongue, a second straight tongue (155*c*), perpendicular to the lateral faces (151) and positioned at a same distance d2 from the end face (152') opposite to the first end face (152), and, on the opposite assembly face (156), a second straight groove (158*c*), perpendicular to the lateral faces (151), substantially opposite a corresponding tongue (155*c*) and substantially complementary to it. The width E' of said second groove (158*c*) is smaller than said dimension E. The width B' of said second tongue (155*c*) is substantially equal to said dimension B. The configuration of said tongues 155*a*, 155*b* and 155*c* and said grooves 158*a*, 158*b* and 158*c* make them compatible with the bricks (16) used for the construction of the other members of the wall (4). These bricks (15") have in addition, on one assembly face (153), two straight tongues (155*a*, 155*b*), parallel to the lateral faces (151) and positioned at the same distance d1 from the lateral faces (151), and, on the opposite assembly face (156), two straight grooves (158*a*, 158*b*), parallel to the lateral faces (151), substantially opposite the corresponding tongues (155*a*, 155*b*) and substantially complementary to them.

The bricks (15') and (15") have in addition flat surfaces (154, 157) between the tongues and the grooves which act as sliding surfaces (19) for the bricks against each other (see FIG. 3).

AS illustrated in FIGS. 5 to 7, the bricks according to the invention, including their projections and recesses, may be symmetrical with respect to a plane parallel to the lateral faces (151) in order to simplify their use.

The bricks according to the invention typically have a substantially hexahedral shape, and in particular a substantially parallelepipedal shape.

Said projections and recesses typically have a rounded shape. For example, as illustrated in FIG. 4, this rounded shape may be defined partially or completely by curve radii R1, R2, R3 and R4, whose centre may be situated in the plane of the flat surface of the assembly face or be offset by a distance X with respect to this surface.

The ring furnace according to the invention is designed for the firing of carbonaceous blocks, especially the anodes of igneous electrolytic cells designed for the production of aluminium.

The invention claimed is:

1. Ring furnace comprising a plurality of inner partitions forming a series of distinct firing sections and pits within the sections, said partitions comprising transversal walls to separate said sections and hollow partitions to separate the pits, at least one of said inner partitions being formed by a plurality of bricks made of a refractory material including at least a first, a second and a third brick, each comprising at least two opposite lateral faces, positioned in parallel to the longitudinal direction L of the partition, two opposite end faces and two opposite assembly faces and each comprising at least one flat surface, said first and said second bricks being situated above or below said third brick and positioned so that their end faces facing one another are separated by a space of width J, wherein said first brick has at least a first recess on its assembly face opposite the third brick, said recess having a dimension E in said longitudinal direction L of said partition, wherein said third brick has at least a first projection on its assembly face facing said first brick, said first projection having a dimension B in said longitudinal direction L of said partition and being inserted into said recess, wherein, so as to allow relative movements between said first and said third bricks in said longitudinal direction of said partition during the operation of the furnace, said dimension E of said recess is greater than said dimension B of said first projection, and wherein, in order to form a stop for said projection on the side of said space, said recess is positioned at a determined distance Se from the end face adjacent to said space.

2. Furnace according to claim 1, wherein the centre of said first projection is offset by a determined distance C with respect to the centre of said recess.

3. Furnace according to claim 2, wherein said offset is such that the space between the surface of said projection and the surface of said recess is smaller on the side of said space than on the opposite side.

4. Furnace according to claim 1, wherein said determined distance Se is between 10 and 30% of the length L1 of said first brick.

5. Furnace according to claim 1, wherein said first projection is positioned at a determined distance Sb from the end face adjacent to said space.

6. Furnace according to claim 1, wherein said first projection is a first straight tongue, positioned perpendicularly to said longitudinal direction L of said partition and said first recess is a first straight groove, positioned perpendicularly to said longitudinal direction L of said partition.

7. Furnace according to claim 6, wherein said straight groove has a bottom that is substantially flat and has a width P greater than or equal to the difference D between said dimension E and said dimension B.

8. Furnace according to any one of claim 1, wherein the difference D between said dimension E and said dimension B is greater than 10 mm.

9. Furnace according to claim 1, wherein said second brick also has at least one recess on its assembly face facing said third brick, said recess having a dimension E' in said longitudinal direction L of said partition, wherein said third brick has at least a second projection on its assembly face facing said second brick, said second projection having a dimension B' in said longitudinal direction L of said partition and being inserted in said recess, wherein said dimension E' of said recess is greater than said dimension B' of said second projection, and wherein said recess is positioned at a determined distance Se' from the end face adjacent to said space.

10. Furnace according to claim 9, wherein the centre of said second projection is offset by a determined distance C' with respect to the centre of the corresponding recess.

11. Furnace according to claim 10, wherein said offset is such that the space between the surface of said second projection and the surface of said corresponding recess is smaller on the side of said space than on the opposite side.

12. Furnace according to claim 9, wherein said determined distance Se' is between 10 and 30% of the length L1 of said second brick.

13. Furnace according to claim 9, wherein said second projection is positioned at a determined distance Sb' from the end face adjacent to said space.

14. Furnace according to claim 9, wherein said second projection is a second straight tongue, positioned perpendicularly to said longitudinal direction L of said partition and said corresponding recess is a straight groove, positioned perpendicularly to said longitudinal direction L of said partition.

15. Furnace according to claim 14, wherein said groove has a bottom that is substantially flat and has a width P' greater than or equal to the difference D' between said dimension E' and said dimension B'.

16. Furnace according to any one of claims 9 to 15, wherein said difference D' between said dimension E' and said dimension B' is greater than 10 mm.

17. Furnace according to claim 1, wherein said first and second bricks further have at least one straight groove positioned in parallel to said lateral faces and said third brick has at least one straight tongue also positioned in parallel to said lateral faces and corresponding to said groove.

18. Furnace according to claim 1, wherein said partition is one of the transversal walls of said furnace.

19. Furnace according to claim 18, wherein said transversal wall has indentations in which are embedded hollow partitions, and wherein said first, second and third bricks are positioned completely or partially in the indentations.

* * * * *